United States Patent [19]

Galuppi

[11] 4,264,842

[45] Apr. 28, 1981

[54] HELIX TYPE TRAVELING-WAVE TUBES WITH AUXILIARY SELECTIVE SHIELDING PROVIDED BY CONDUCTIVE ELEMENTS APPLIED UPON DIELECTRIC SUPPORTS

[75] Inventor: Paolo Galuppi, Rome, Italy

[73] Assignee: Elettronica S.p.a., Rome, Italy

[21] Appl. No.: 953,446

[22] Filed: Oct. 23, 1978

[30] Foreign Application Priority Data

Oct. 28, 1977 [IT] Italy ..... 51618 A/77

[51] Int. Cl.[3] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 3,387,168 | 6/1968 | Beaver | 315/3.5 |
| 3,397,339 | 8/1968 | Beaver et al. | 315/3.5 |
| 3,654,509 | 4/1972 | Scott et al. | 315/3.5 |
| 3,809,949 | 5/1974 | Scott | 315/3.6 |
| 3,832,593 | 8/1974 | Gross | 315/3.5 |
| 3,903,449 | 9/1975 | Scott et al. | 315/3.5 |
| 3,972,005 | 7/1976 | Nevins, Jr. et al. | 315/3.5 |
| 4,005,329 | 1/1977 | Manoly | 315/3.5 |

*Primary Examiner*—Saxfield Chatmon, Jr.
*Attorney, Agent, or Firm*—Jacobs & Jacobs

[57] ABSTRACT

A helix type traveling-wave tube comprises a conductive tubular envelope wherein a coaxial helix interaction structure is provided, the function of which is to shield the electromagnetic wave of the signal. By a proper arrangement of metallic conductive elements suitably applied upon dielectric support rods firmly inserted between the inner conductive surface of said tubular envelope and outer perimetrical surface of said helix, a selective shielding may be attained in order that the helix dispersions are almost null or even negative and the operative frequency band is remarkably extended with a substantially constant velocity of phase.

6 Claims, 11 Drawing Figures

HELIX TYPE TRAVELING-WAVE TUBES WITH AUXILIARY SELECTIVE SHIELDING PROVIDED BY CONDUCTIVE ELEMENTS APPLIED UPON DIELECTRIC SUPPORTS

BACKGROUND OF THE INVENTION

The present invention relates to traveling-wave tubes and particularly to TWTs having helix interaction structure placed coaxially within a conductive tubular envelope, the function of which is to shield the electromagnetic wave of the signal. A proper arrangement of metallic conductive fins or elements is provided so that the shielding may be selective in order that the helix dispersions are almost null or even negative and a remarkable extent of the operative frequency band may be attained with a substantially constant phase velocity. Remarkable advantages then result from the use of electron TWTs whose characteristics are in accordance with the present invention.

It is well known by the skilled in the art that in a traveling-wave tube to be used as a tube amplifier, the phenomenon of interaction is utilized, which may be provided between an electron beam that after being emitted by an electron gun cathode enters a delay line, or interaction structure, and moves through the same, and the electromagnetic-wave of the signal which propagates along a considerable length of the electron tube. The propagation of the traveling wave is in the same direction of electron motion. In order that the interaction phenomenon may take place a well predetermined velocity ratio is however necessary, namely between electron velocity of said electron beam and propagation velocity of the electromagnetic wave phase in the structure.

Furthermore, in order that this phenomenon of interaction may be really useful for practical purposes as desired, it is also necessary that a right velocity ratio may be maintained on all frequencies of the operative band, while such a velocity ratio is generally compromised because the propagation velocity of electromagnetic wave phase of the signal in the structure changes on the basis of the frequency. More than that, it must be added that, because of such variation of wave phase velocity in the structure, which is defined as dispersion of the phase velocity, it is quite possible that the condition giving rise to the interaction phenomenon is lost when the bandwidth exceeds a certain value.

The delay lines being used as interaction structures in traveling-wave tubes and forming transmission lines having very small dispersions and a very small distorsion with time delay, may be of many types, each one having characteristics of phase velocity dispersion more or less accentuated. One of the simpler, better and more used is the helix type as a slow wave circuit where the waves propagate along the wire almost at the light velocity, the phase velocity in the axial direction being then nearly equal to the velocity of light multiplied by the pitch/circle ratio.

Helixes are then delay lines having a lower dispersion, the usually attained bandwith by traveling-wave tubes wherein they are used being one octave. As regards broader bandwith, however, the dispersion of phase velocity provides some fall of output useful power near the edges thereof, which in many cases cannot be borne.

In electron tubes wherein for the purposes of the present invention a helix type interaction structure is provided as evidenced above, the propagation velocity of the wave phase increases when the frequency is decreasing (i.e. positive dispersion), while the phase velocity should have a lightly increasing state by a frequency increase (i.e. negative dispersion), or at the most a null dispersion to maintain the most suitable interaction conditions for said purposes.

SUMMARY OF THE INVENTION

A main object of the present invention is therefore to provide an electron tube with a coaxial interaction structure of the helix type which is suitable to modify the natural positive phase velocity dispersion of helix, so that almost null dispersions or even negative dispersions may be obtained.

As a matter of fact, such a purpose has already drawn the attention of the skilled in the art, so that in prior electron tubes suggestions and applications may be found to carry out same. It is, for example, interesting to mention a helix type interaction structure which comprises a conductive envelope acting as a shield for the signal electromagnetic wave and formed by a cylindrical tube coaxial with the helix. In such an interaction structure the control of dispersion characteristics is carried out by selecting the ratio between diameter of the cylindrical conductive envelope acting as a shield and diameter of the helix, being thus possible to attain negative dispersions when such a ratio is brought to sufficiently small values.

In a practical way, it is however not easy and many are the drawbacks to reach very small values of said diameter ratio, particularly because some other parameters of the interaction structure are compromised.

That main object of the present invention is then attained by providing said helix interaction structure in such a manner that a selective shielding is allowed which acts differently on the electromagnetic field components, that shielding being not only and directly depending on said cylindrical conductive tube forming the outer envelope of the interaction structure coaxial with the helix, but depending also on some proper conductive elements in the form of fins, wires, coatings, which extend longitudinally within the envelope parallel to the helix axis and spaced out therefrom to provide such a shielding conduction which is to be considered the most suitable to modify the natural positive dispersion of the helix.

On the other hand, the selective shielding as provided by the present invention has the purpose to eliminate the drawbacks being possible through the suggestions and applications of prior art. To accomplish same, conductive elements are provided which are applied directly upon or in the dielectric supports which are interposed between the inner surface of the cylindrical conductive envelope and the outer perimetrical surface of the helix, which is coaxial in the interaction structure. This not only makes the supply of the conductive elements in the interaction structure easier, but also helps to reach shielding effects as desired in a very wide range of selections when one takes advantage of the direct relationship between the position and characteristics of the auxiliary conductive shielding fin or fins applied upon said dielectric supports with reference to the central helix of the structure, and the dispersion modification of phase propagation of the signal electromagnetic wave which depends on said position and characteristics. The application of conductive elements on the dielectric supports gives a further advantage, namely the possibility of employing a conventional electron glass tube as cylindrical conductive tubular envelope having an inner conductive lining, this being impossible when auxiliary conductive fins are applied according to prior art, that is to say radially protruding from the inner conductive surface of the tube and longitudinally extended along the same.

To evidence the basic principles of the present invention as well as the improvements actually attainable through practical embodiments of the helix interaction structure in accordance with said principles, some examples of prior and new art are described hereafter with reference to the accompanying drawings in which:

FIG. 1 is a schematic longitudinal view of a helix interaction structure a partial length of which is shown in longitudinal section, wherein the coaxial outer envelope and inner helix are firmly attached to each other in a spaced condition by means of intermediate radial support rods, such a structure allowing a modification of the helix dispersion through shielding plates fixed radially the inner surface of the envelope.

Figure 5:
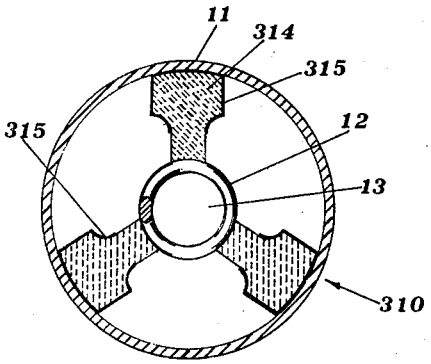
FIG. 5 is another schematic cross-section view of a helix interaction structure like FIG. 2, however showing a third exemplificative embodiment in accordance with the present invention.
Figure 6:
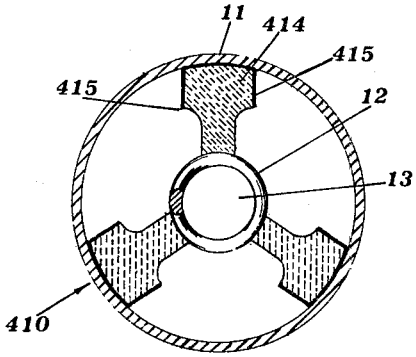
FIG. 6 is another schematic cross-section view of a helix interaction structure like FIG. 2, however showing a fourth exemplificative embodiment according to the present invention.
Figure 11:
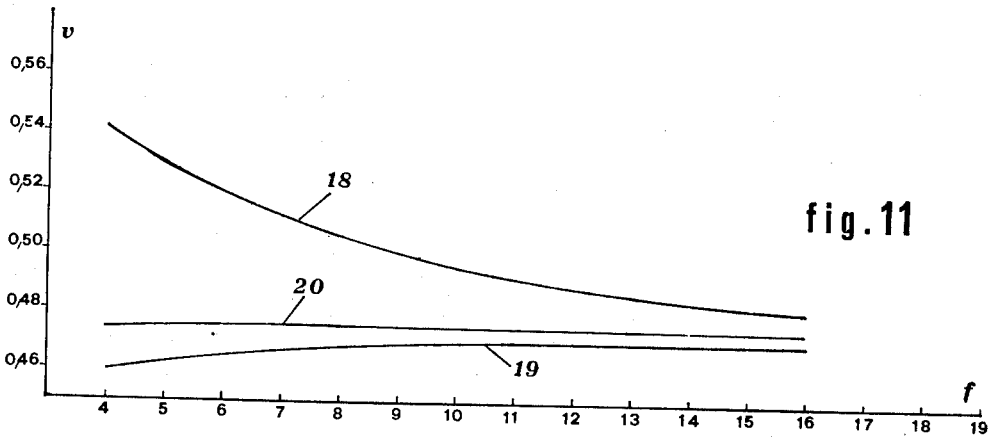

FIG. 11 shows three more experimentally plotted diagrams wherein the phase velocity is related to the frequency when intermediate supports are used of a no-metallized type (curve 18) and metallized type in accordance with embodiment shown in FIG. 5 (curve 19) and FIG. 6 (curve 20).

Before examining the accompanying drawings it is to point out that the several examples of embodiment relating to helix interaction structures in accordance with the present invention are illustrated and will be described to evidence that a typical helix interaction structure may lead to a modification of helix dispersion when a selectively predetermined auxiliary shielding is provided in order that the propagation velocity of the signal electromagnetic wave phase results almost constant while a frequency variation takes place, or quite a negative dispersion may be provided. The higher the shielding effect, the lower the dispersion of propagation velocity of the electromagnetic wave phase, so that more constant is the velocity by itself while the frequency is varying. By increasing this shielding effect, the dispersion can even become negative (phase velocity increasing with frequency).

Figure 2:
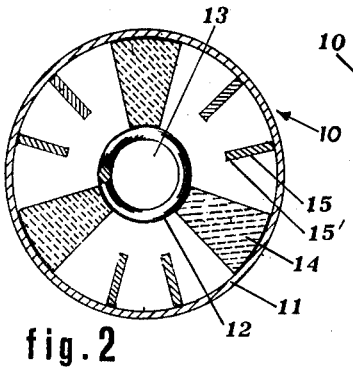
FIG. 2 is a schematic cross-section view of the structure shown in FIG. 1, taken along line 2—2 of this latter.
Figure 1:
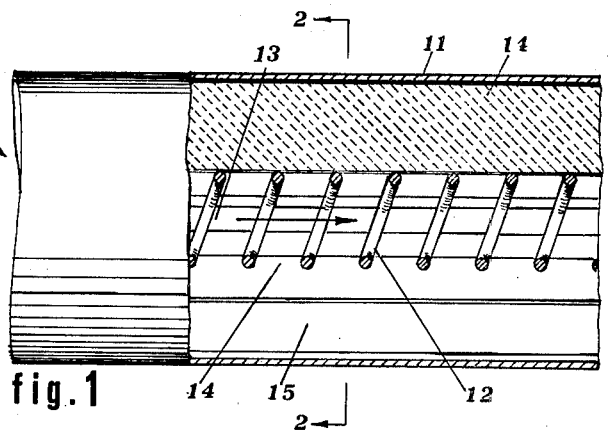

In FIGS. 1 and 2 a typical example of interaction structure according to prior art is shown, wherein the metallic fins to attain a more remarkable shielding effect are applied along the inner surface of the outer tubular envelope, radially protruding towards the tube axis.

Interaction structure 10 that regards a considerable length of the electron tube comprises a tubular conductive envelope 11 and a coaxial helix 12 steady connected therebetween by means of intermediate dielectric support rods 14, the cross-section of which was assumed as trapezoidal the radially opposite sides being in a forced contact with the inner conductive surface of said outer tubular envelope and outer perimetrical surface of helix 12, even through a metal-ceramic brazing.

In the typic example of modified shielding in accordance with this illustration of prior art, auxiliary conductive plates 15 are provided which are firmly applied upon the inner surface of envelope 11 and radially protruding therefrom towards the tube axis, said plates being extended longitudinally along the entire structure with its free ends 15' more or less spaced out from coaxial helix 12, as it is better shown in FIG. 2. The number and distribution of plates 15 as well as the position of ends 15' thereof with respect to the outer perimetrical surface of helix 12 are to be considered some modificative factors of shielding conditions and then modificative factors of the dispersion of propagation velocity of the signal electromagnetic wave.

In FIGS. 3 to 9 cross-section views of interaction structures in accordance with the present invention are shown, scope of which is to evidence improvements and advantages that it is possible to realize when the shielding is modified through a direct intervention upon the dielectric support rods of the structure, such improvements and advantages having a considerable value not only from a constructive point of view but also owing to a greater possibility of a shielding selection. In these figures equal reference characters relates to substantially similar component members of the interaction structure, while to indicate the component members that in these examples have constructive characteristics different, the number 100, 200 etc is respectively added to the original one.

Figure 3:
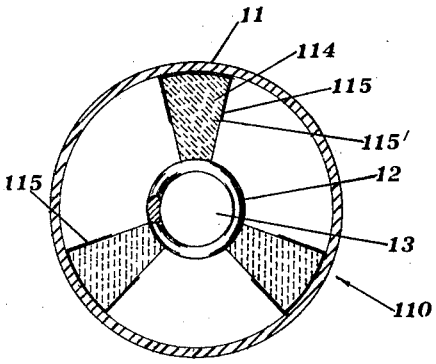
FIG. 3 is a schematic cross-section view of a helix interaction structure like FIG. 2, however relating to a first exemplificative embodiment according to the present invention.

The embodiment of interaction structure as schematically shown in cross-section of FIG. 3 relates to a structure 110 which still comprises a conductive tubular envelope 11 wherein a coaxial helix 12 is fitted in and maintained in position as said above with regard to the typic structure of FIG. 1. However there is since now to point out that an entirely metallic tubular envelope is preferred in the present invention, while a tube of dielectric material, even glass, may be used as said above, such a tube having its inner surface covered with a metal lining forming the main shielding according to prior techniques.

The auxiliary shielding 115 which gives the possibility to modify the shielding effect in accordance with the present invention comprises in this example a metal coating of each dielectric rod 114 along three adjacent side walls of same, three conventional dielectric support rods 114 being generally provided between outer tubular envelope 11 and inner coaxial helix 12, as schematically shown in the drawings. In FIG. 3 such a metal coating indicated with reference number 115 regards the side wall in direct contact with the inner conductive surface of envelope 11 as well as the adjacent walls thereof, that is to say the wall only which is in a forced contact with the outer perimetrical surface of helix 12 is excluded, as explained above.

In this embodiment the shielding metal coating 115 is continuous along said three side walls of each dielectric support rod 114 and has its ends 115' a predetermined distance from the perimetrical surface of helix 12, such a distance being a first factor which influences the shielding modification to be accomplished.

While from said cross-section view of FIG. 3 an electric contact is resulting between conductive coating 115 and conductive inner surface of tubular envelope 11, it is since now to point out that not only such a contact is not indispensable to reach the shielding modification, but also is not even indispensable that coating 115 is continuously, longitudinally extended from beginning to end of the interaction structure which is indicated 110 in this illustration.

These observations have substantially the purpose to point out that in order to accomplish its shielding function the auxiliary conductive coating 115 (indicated by different reference numbers in the examples being cited afterwards) may be conductively independent from the main conductive coating of tube body 11 as well as longitudinally not conductive in a continuous manner from beginning to end of the interaction structure along the entire length of this latter, and may have its longitudinally extended end 115' towards the axis of structure 110 more or less spaced out from the seeming cylindrical surface of helix 12.

Another specification concerning said auxiliary conductive coating relates to the capacity to modify that normal positive dispersion of wave phase propagation velocity which is possible to obtain by same, and particularly the fact that to a higher effectiveness of auxiliary conductive shielding corresponds a greater variation of the phase velocity dispersion, up to a dispersion null or nearly null. Such a variation may also assume the course of a negative dispersion.

Just because of these effect particularities of the auxiliary shielding on electromagnetic wave phase velocity dispersion, it may be important, in a practical way, to discontinue such a coating 115 longitudinally along its dielectric support rod 114, or limit that coating 115, in a continuous or intermittent manner, for example upon two of the three dielectric support rods 114 only, in order to better evidence to the skilled in the art the advantage that from the constructive point of view may derive when the shielding modification is accomplished by a direct operation on dielectric support rods 114. As usually, three dielectric support rods have been supposed in these embodiments, which are uniformly arranged on 360°, while a different number of same may actually be used.

Since this example of interaction structure 110 there is to add that conductive coating 115 may comprise one or more laminar layers applied upon a corresponding dielectric support rod 114 also through chemical or electrolytic deposition, keeping always in mind that such a coating is to be excluded upon that perimetrical surface portion of dielectric rod 114 which contacts directly or is very close to the outer perimetrical surface of helix 12.

In FIGS. 5 to 9 shapes of dielectric support rods are shown which are well in keeping with the constructive requirements of the interaction structure of a corresponding TWT and at the same time allow to modify the shielding capacity of same through a proper selection of the auxiliary conductive coating as above, so that the natural velocity dispersion of the phase propagation may reach conditions of dispersion null or even negative.

In FIG. 5, for example, dielectric support rods 314 of structure 310 have a thicker head in contact with the inner conductive surface of envelope 11, and conductive coating 315 thereof extends towards the thinner shank which, without having any conductive coating, is in contact with the outer perimetrical surface of helix 12. The difference between interaction structure 310 and interaction structure 410 illustrated in FIG. 6 consists substantially in the fact that conductive coating 415 of this latter for auxiliary shielding is not extended dowards dielectric support rod shank, rather limited to the thicker head only thereof.

Now even, through the comparison of experimental results relating to the velocity of electromagnetic wave phase propagation of the signal as obtained in the auxiliary shielding conditions of FIGS. 5 and 6, besides using non-conductive dielectric support rods, it has been possible to deduce that the velocity dispersion may change from a normal course of positive dispersion to a dispersion almost null or even to a negative dispersion. These results have been transferred on orthogonal-axses diagrams of FIG. 11, wherein the phase velocity (ordinate) is referred to the frequency (abscissa).

When interaction structures having dielectric support rods without any conductive coating are used, a plot of the phase velocity as a function of frequency shows a gradually decreasing curve with a change from a phase velocity of about $0.54\times10^8$ m/sec vs. a frequency of about 4 GHz, to a phase velocity of about $0.475\times10^8$ m/sec vs. a frequency of about 16 GHz. Practically, such a course of the phase velocities versus the frequency of undoubtedly an indicative factor of notable positive dispersion, the disadvantages of which will at once be evident to the skilled in the art.

A dispersion almost null of the phase velocity may be noticed through curve 20, the course of which is nearly horizontal with a phase velocity of about $0.48\times10^8$ m/sec at any frequency value, from about 4 to 16 GHz, the diagram of results being referred to the auxiliary shielding carried out as illustrated by schematic view of FIG. 6, i.e. with a conductive coating 415 limited to the thicker head only of dielectric support rods 414.

The velocity dispersion in accordance with curve 19 is a negative dispersion as attained in embodiment of auxiliary shielding as shown in FIG. 5, that is to say with a further advantage resulting from a further extension of coating 315 towards dielectric shank 314 and then towards helix 12.

Figure 8:
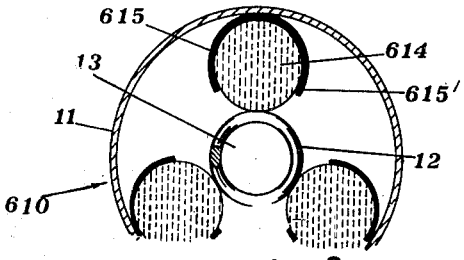
FIG. 8 is a cross-section view of an interaction structure according to a sixth exemplificative embodiment of the present invention.
Figure 10:
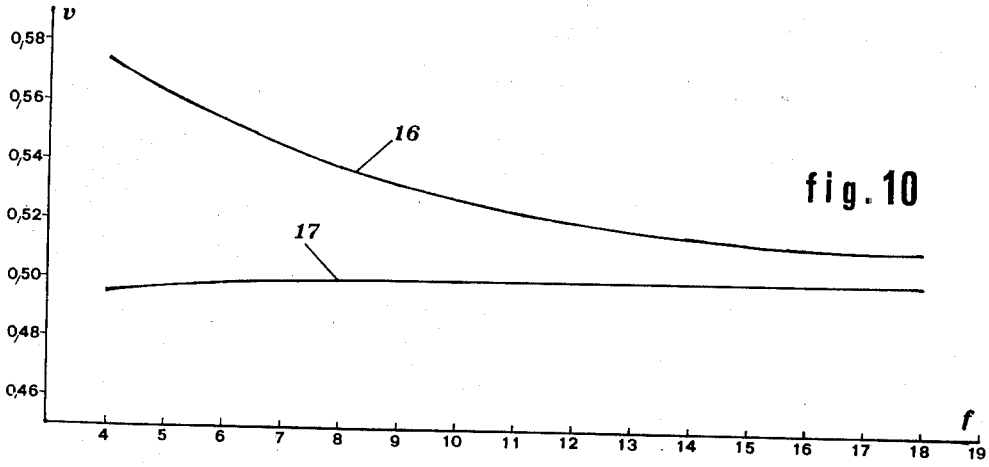
FIG. 10 is a typical phase velocity/frequency diagram plotted experimentally by using a helix interaction structure as in the exemplificative embodiment shown in FIG. 8, which is compared with the example shown in FIGS. 1 and 2 referred to embodiments of prior art.

By the example illustrated in FIG. 8 it has been evidenced both the possible utilization of dielectric support rods having a different shape, namely a more advantageous constructive feature also becaune any desired conductive coating may be provided, and the possibility to modify the usual positive dispersion of the phase velocity owing to the use of such a different shape of the dielectric support rods. In practical experiments, this support 610 has been provided by cylindrical rods 614 of a dielectric material, the conductive coating 615 of which was remarkably shown in FIG. 8. The two ends 615' of conductive coating 615 are fairly near to the perimetrical outer surface of helix 12, similarly to description and illustration of FIG. 5. Laboratory examinations have been carried out which confirmed the modification of normal positive dispersion of the phase velocity, obtainable also by means of such an interaction structure. Results of these laboratory examinations are shown in curves 16, 17 of FIG. 10 and correspond to variations of phase velocity when an interaction structure having such a shape of dielectric support rods is used, without or with a conductive coating 615, respectively. Similarly to the remark concerning the interaction structure of FIG. 5, in FIG. 10 the curve 16 relates to the positive dispersion and FIG. 17 relates to negative dispersion when said interaction structure of FIG. 8 is used. That is to say; a change is possible from a positive dispersion as plotted in curve 16 to a negative dispersion as in curve 17, this latter resulting from the use of an interaction structure as in FIG. 8.

These results are similar to those concerning the interaction structure of FIG. 5, the negative dispersion curve of which is indicated by the reference number 19 in FIG. 11, as described above.

When conductive metal coatings are provided to embody auxiliary shieldings of TWTs, as particularly evidenced in above examples referred to the present invention, a further advantage may be noticed by the skilled in the art as owed to the better performances of such a TWT and consists in the shielding effect of the dielectric supports with a consequent lower effect of dielectric charging. That advantage will be reflected as a performance increase of the TWT.

Figure 4:
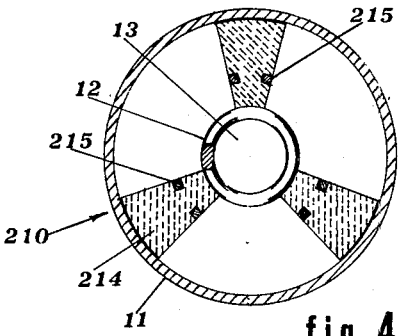
FIG. 4 is a further schematic cross-section view of a helix interaction structure like FIG. 2, however showing a second exemplificative embodiment according to the present invention.
Figure 7:
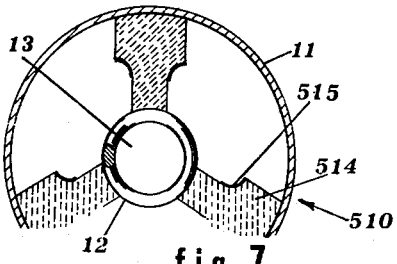
FIG. 7 is a further cross-section view of a helix interaction structure like FIG. 6, however in accordance with a fifth exemplificative embodiment of the present invention.
Figure 9:
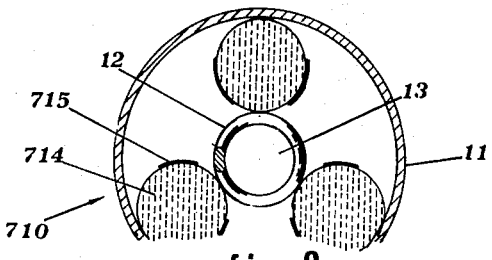
FIG. 9 is a cross-section view of a seventh exemplificative embodiment of interaction structure of the helix type according to the present invention.

A certain advantage is also drawn by means of a metallization more localized as, for instance, shown in FIGS. 4, 7, 9. Embodiments illustrated in these figures relate to auxiliary shieldings longitudinally localized in a dielectric support zone which is intermediate between the outer conductive envelope and the helix, nearer to this latter. In FIG. 4 it was assumed that a thread-like conductive shield 215 is housed within a suitable longitudinal groove, along the side walls of each dielectric support rod 214. In FIG. 7 conductive shield 515 comprises a metallic coating longitudinally housed in the passage zone between the head and shank of dielectric support rod 514, while a partial coating 715 is longitudinally provided upon cylindrical dielectric support rod 714, as shown in FIG. 9.

For all these types of conductive elements having the function of auxiliary shields in the interaction structures being selected as embodiment examples of the present invention, it is obviously to keep in mind what has been stated in advance in relation to the characteristics of same in order to carry out such a function. These conductive elements are preferably to be provided through a suitable metallization of the insulated supports of the interaction structure. In addition to the selection of a metal tubular body as envelope, as said above, to constitute tube 11 of the structure, there is here to say that beryllium oxide rods have been preferred to perform said insulated supports, the rods being plated with a copper coating. When a chemical plating is to be accomplished, the rod surface is first subjected to a conventional degreasing operation, then to a sensitization process in a gold chloride bath, or to a process of activation in a palladium chloride bath. The subsequent process of copper plating is protracted until a coating thickness of about 10 to 15$\mu$ is obtained and extended, in a first time, to all the rod surface in order to define successively by etching the desired coated area. That is to say, the surfaces to be maintained in its metallized copper coated state are protected by means of paints, while from the remaining surfaces to be non-metallized the already plated metal is removed by etching.

As said above, the helixes are delay lines having the lowest dispersion and the TWTs wherein they are employed have operative bandwidth in the range of one octave. This generic characteristic, which is important by itself, is notably improved in TWTs manufactured in accordance with the present invention. In these TWTs remarkably broader bandwidth may be attained, up to useful bandwidth in the range of two octaves.

While several examples of embodiment of the present invention have been described and illustrated, there is to point out that they do not have a limitative value, so that changes and modifications may be selected by the skilled in the art and considered as falling within the scope of the present invention and thereby claimed when based on the fundamental principles of same. Thus, for instance, auxiliary shields of interaction structures may be provided by directly selecting the support rod composition and preparing same by using powdered dielectric material and powdered metal to be compressed together in such a manner and desired form to be really suitable to carry on its function.

On the other hand, wires or metallic foil may properly be included within dielectric supports formed as a single piece or in two or more pieces assembled together and then used as a single piece containing the metal portions, the function of which being that of an auxiliary shield to accomplish above desired purposes.

I claim:

1. In a high frequency traveling-wave tube amplifier with helix type interaction structure comprising a conductive envelope as a main shielding member of signal electromagnetic wave, a helix type slow wave interaction delay line means axially disposed within said conductive envelope, and a plurality of dielectric support rods circumferentially spaced and longitudinally interposed between said conductive envelope and helix, the improvement which comprises providing a conductive loading structure in the form of conductive elements integral with said dielectric support rods and longitudinally disposed along the same, the respective conductive elements of each dielectric support rod being as near as possible to the helix but out of contact therewith, said conductive loading structure being operable to provide selective auxiliary shielding means in addition to said main shielding envelope and to modify the natural positive phase velocity dispersion of the helix and attain a dispersion characteristic which may be substantially null or even negative, so that a widening of the operative frequency band up to two octaves or more is provided with a substantially constant phase velocity.

2. Apparatus according to claim 1, wherein said conductive loading structure comprises a perimetral conductive coating lying on that part of the outer surface area of at least one dielectric support rod which faces the conductive envelope and extends longitudinally along said dielectric support rod in a continuous or intermittent manner, both edges of said perimetrical conductive coating being spaced away from the outer perimetrical surface of the helix depending on the desired auxiliary shielding effect to be obtained.

3. Apparatus according to claim 2, wherein said dielectric support rods have a predetermined cross-section and are provided with said conductive coating to attain the desired auxiliary shielding effect.

4. Apparatus according to claim 2, wherein said conductive coating is perimetrically extended upon some parts only of corresponding dielectric support rods facing the inside perimetrical surface of said conductive envelope but out of contact therewith.

5. Apparatus according to claim 1, wherein said conductive loading structure comprises metallic material deposited upon selected perimetrical surface areas of said dielectric support rods.

6. In a high frequency traveling-wave tube amplifier with helix type interaction structure comprising a conductive envelope as a main shielding member of signal electromagnetic wave, a helix type slow wave interaction delay line means axially contained within said conductive envelope, and a plurality of dielectric support rods circumferentially spaced and longitudinally interposed between said helix and conductive envelope, the improvement which comprises an additional conductive loading structure, said loading structure comprising metallic elements housed longitudinally within one or more of said dielectric support rods and integral therewith, and properly spaced out from the perimetrical outside surface of said helix, the dimensions and position of said metallic elements depending on the desired selective auxiliary shielding effect to be obtained, in order to modify the natural positive phase velocity dispersion of the helix and attain a dispersion characteristic which may be substantially null or even negative, so that a widening of the operative frequency band up to two octaves or more is provided with a substantially constant phase velocity.

* * * * *